US006406823B2

(12) United States Patent
Melnyk et al.

(10) Patent No.: US 6,406,823 B2
(45) Date of Patent: Jun. 18, 2002

(54) PHOTORECEPTOR AND METHOD INVOLVING RESIDUAL VOLTAGES

(75) Inventors: Andrew R. Melnyk, Rochester; Paul A. Harmer, Ontario; Kathleen M. Carmichael, Williamson, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/736,108

(22) Filed: Dec. 13, 2000

Related U.S. Application Data

(62) Division of application No. 09/421,863, filed on Oct. 20, 1999, now abandoned.

(51) Int. Cl.[7] ..... G03G 13/01
(52) U.S. Cl. ..... 430/46; 430/54
(58) Field of Search ..... 430/46, 42, 57.2, 430/57.3, 54

(56) References Cited

U.S. PATENT DOCUMENTS

| | | | |
|---|---|---|---|
| 4,078,929 A | 3/1978 | Gundlach | 96/1.2 |
| 4,308,330 A | 12/1981 | Kaukeinen et al. | 430/46 |
| 4,378,415 A | 3/1983 | Chu | 430/45 |
| 4,390,610 A | 6/1983 | Bowden et al. | 430/58 |
| 4,555,463 A | 11/1985 | Hor et al. | 430/59 |
| 5,002,845 A | 3/1991 | Shimura et al. | 430/59 |
| 5,213,927 A | 5/1993 | Kan et al. | 430/59 |
| 5,230,974 A | 7/1993 | Pai et al. | 430/54 |
| 5,241,358 A | 8/1993 | Germain et al. | 355/326 |
| 5,347,303 A | 9/1994 | Kovacs et al. | 346/157 |
| 5,534,980 A | 7/1996 | Tanaka | 355/219 |
| 5,849,445 A | 12/1998 | Visser et al. | 430/59 |

FOREIGN PATENT DOCUMENTS

JP 63-038942 2/1988

OTHER PUBLICATIONS

C. Griffiths and A. Melnyk, "Ambipolar Photoresponsive Devices", Xerox Disclosure Journal, vol. 7, No. 6, Nov. 1982, p. 385.

Borsenberger, Paul M. et al, Organic Photoreceptors for Imaging Systems, New York: Marcel–Dekker, Inc., 1993, pp. 6–11, 346–7, 366–7, 382–3.

*Primary Examiner*—Christopher Rodee
(74) *Attorney, Agent, or Firm*—Zosan S. Soong

(57) ABSTRACT

A photoreceptor including: a charge transport layer; a top charge generating layer sensitive to a first light wavelength; a bottom charge generating layer sensitive to a second light wavelength; and a substrate, wherein the charge transport layer is positioned anywhere above the substrate, wherein the photoreceptor exhibits in response to exposure by the first light wavelength a first photodischarge curve having a first residual voltage and the photoreceptor exhibits in response to exposure by the second light wavelength a second photodischarge curve having a second residual voltage.

4 Claims, 5 Drawing Sheets

PHOTORECEPTOR AND METHOD INVOLVING RESIDUAL VOLTAGES

This application is a divisional of application No. 09/421,863, filed Oct. 20, 1999 abandoned.

FIELD OF THE INVENTION

This invention relates to electrophotography and particularly to a photoreceptor that photodischarges to different residual voltages depending on the wavelength of light employed.

BACKGROUND OF THE INVENTION

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography, the xerographic contrast on the charge retentive surface of photoreceptor is divided three, rather than two, ways as is the case in conventional xerography. The photoreceptor is charged, typically to 900 v. It is exposed imagewise, such that one image corresponding to charged image areas (which are subsequently developed by charged area development, i.e., CAD) stays at the full photoreceptor potential ($V_{high}$ or $V_{cad}$). The other image is exposed to discharge the photoreceptor to its residual potential, i.e., $V_{low}$ or $V_{dad}$ (typically 100 v) which corresponds to discharged area images that are subsequently developed by discharged-area development (DAD). The background areas exposed such as to reduce the photoreceptor potential to halfway between the $V_{cad}$ and $V_{dad}$ potentials, (typically 500 v) and is referred to as $V_w$ or $V_{white}$. The CAD developer is typically biased about 100 v closer to $V_{cad}$ than $V_{white}$ (about 600 v), and the DAD developer system is biased about 100 v closer to $V_{dad}$ than $V_{white}$ (about 400 v).

Because the composite image developed on the charge retentive surface consists of both positive and negative toner a pre-transfer corona charging step is necessary to bring all the toner to a common polarity so it can be transferred using corona charge of the opposite polarity.

Various techniques have heretofore been employed to develop electrostatic images as illustrated by the following disclosures which may be relevant to certain aspects of the present invention: Kovacs et al., U.S. Pat. No. 5,347,303; Germain et al., U.S. Pat. No. 5,241,358; Visser et al., U.S. Pat. No. 5,849,445; Tanaka, U.S. Pat. No. 5,534,980; Pai et al., U.S. Pat. No. 5,230,974; Kan et al., U.S. Pat. No. 5,213,927; Shimura et al., U.S. Pat. No. 5,002,845; and Bowden et al., U.S. Pat. No. 4,390,610.

SUMMARY OF THE INVENTION

The present invention is accomplished in embodiments by providing a photoreceptor comprising: a charge transport layer; a top charge generating layer sensitive to a first light wavelength; a bottom charge generating layer sensitive to a second light wavelength; and a substrate, wherein the charge transport layer is positioned anywhere above the substrate, wherein the photoreceptor exhibits in response to exposure by the first light wavelength a first photodischarge curve having a first residual voltage and the photoreceptor exhibits in response to exposure by the second light wavelength a second photodischarge curve having a second residual voltage.

There is provided in embodiments, a photoreceptor further including an intermediate charge generating layer sensitive to a third light wavelength, disposed between the top generating layer and the bottom generating layer, wherein the photoreceptor exhibits in response to exposure by the third light wavelength a third photodischarge curve having a third residual voltage.

Embodiments of the present invention also include a printing machine comprising:

(a) a photoreceptor comprising: a charge transport layer; a top charge generating layer sensitive to a first light wavelength; a bottom charge generating layer sensitive to a second light wavelength; and a substrate, wherein the charge transport layer is positioned anywhere above the substrate, wherein the photoreceptor exhibits in response to exposure by the first light wavelength a first photodischarge curve having a first residual voltage and the photoreceptor exhibits in response to exposure by the second light wavelength a second photodischarge curve having a second residual voltage; and (b) a light exposure apparatus that emits at least the first light wavelength and the second light wavelength at the photoreceptor.

The term "sequence" indicates the order of the layers in the photoreceptor. Unless indicated to the contrary, one or more other layers described herein can be inserted over, under, or between two layers that are sequentially listed. The term "contiguous" that is used to describe for example a bottom charge generating layer that is contiguous to the top charge generating layer indicates the absence of any other layer between the top and bottom generating layers.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
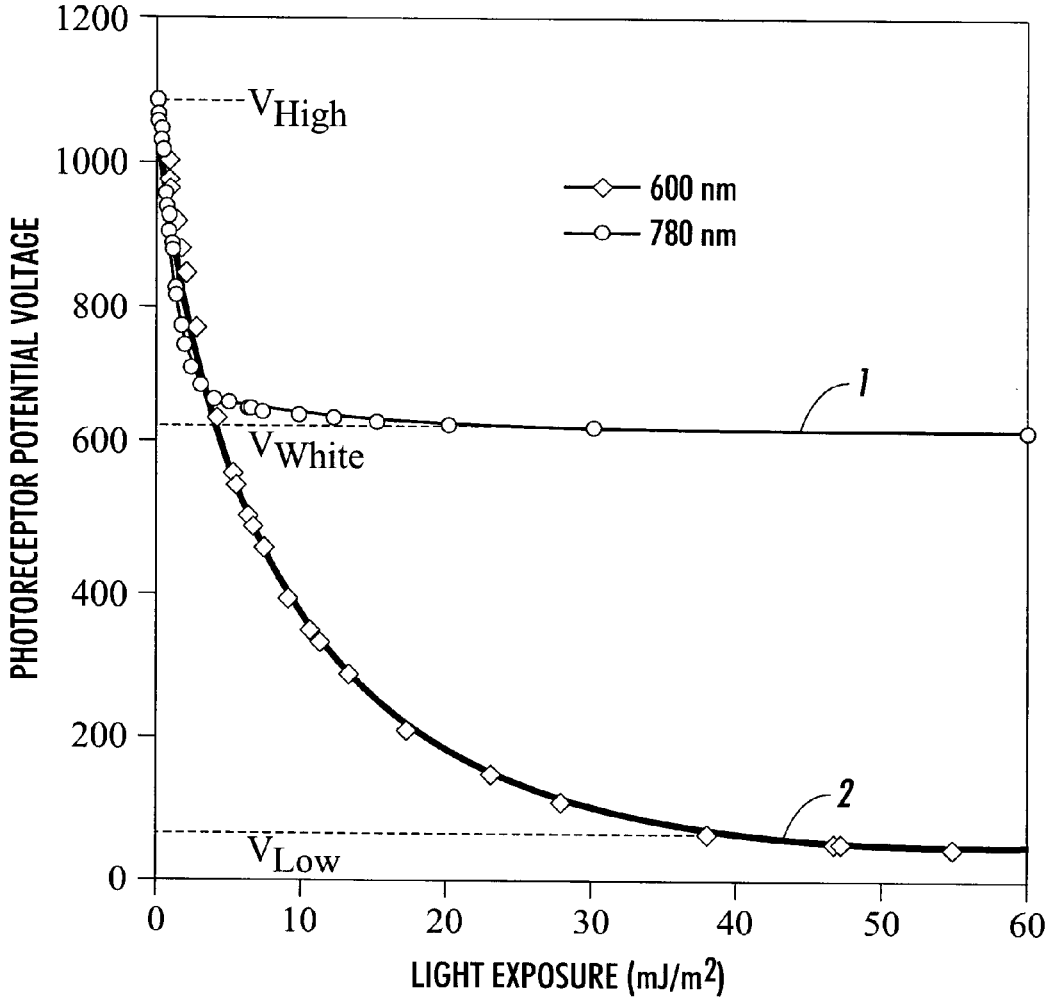
FIG. 1 is a plot of photoreceptor potential voltage versus exposure at two different light wavelength ranges illustrating a tri-level electrostatic latent image for the present photoreceptor.
Figure 2:
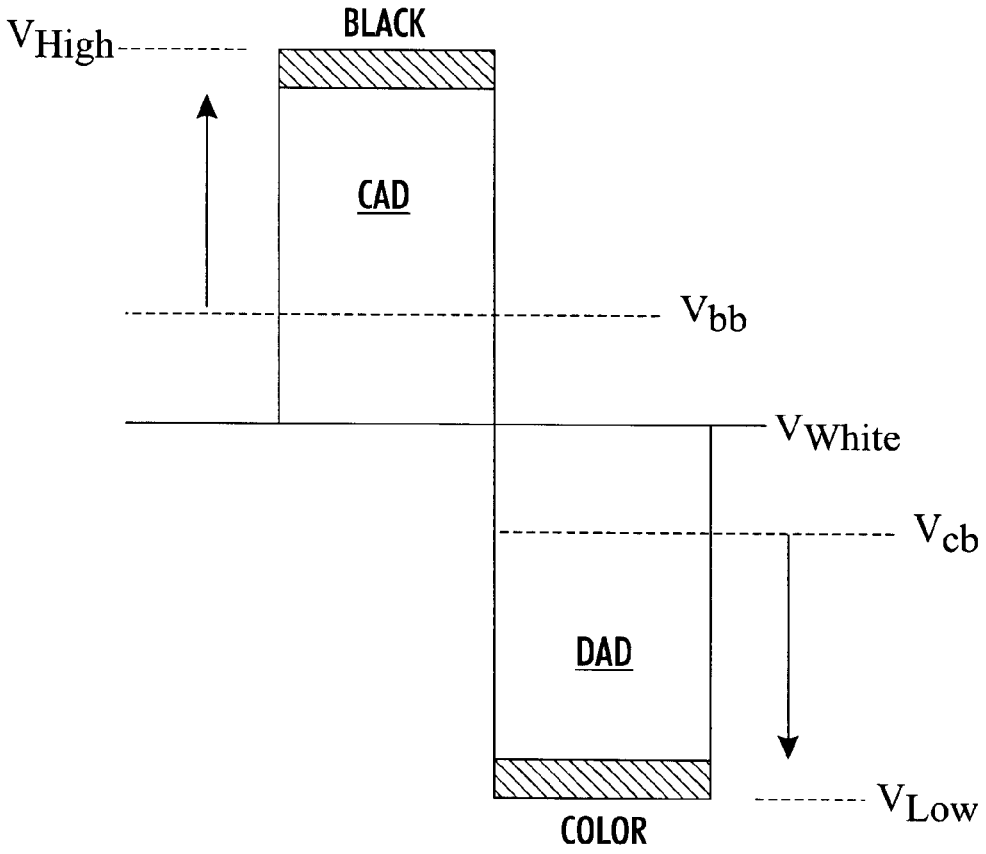
FIG. 2 is a plot of photoreceptor potential voltage illustrating single-pass, highlight color latent image characteristics.

For a better understanding of the concept of tri-level imaging used by the present invention, a description thereof will now be made with reference to FIGS. 1 and 2. FIG. 1 illustrates the tri-level electrostatic latent image for the present invention in more detail. FIG. 1 consists of two photoinduced discharge curves, 1 and 2, produced by exposure to two different bands of light wavelengths. Here $V_{high}$ is the dark (unexposed) or high potential, $V_{white}$ the white discharge level corresponding to the photoreceptor residual potential (full exposure) for light wavelength 780 nm and $V_{low}$ the photoreceptor residual potential (fall exposure) for light wavelength 600 nm. The terms residual potential and residual voltage can be used interchangeably.

Residual voltage or residual potential refers to that minimum voltage on a photodischarge curve at which additional light exposure results in insignificant further discharge of the photoreceptor.

Color discrimination in the development of the electrostatic latent image is achieved by passing the photoreceptor through two developer housings in tandem where the housings are electrically biased to voltages which are offset from the background voltage $V_{white}$, the direction of offset depending on the polarity or sign of toner in the housing. One housing (for the sake of illustration, the second) contains developer with black toner having triboelectric properties such that the toner is driven to the most highly charged ($V_{high}$) areas of the latent image by the electric field between the photoreceptor and the development rolls biased at $V_{bb}$ (V black bias) as shown in FIG. 2. Conversely, the triboelectric charge on the colored toner in the first housing is chosen so that the toner is urged towards parts of the latent image at residual potential, $V_{low}$ by the electric field existing between the photoreceptor and the development rolls in the first housing at bias voltage $V_{cb}$ (V color bias).

Figure 3:
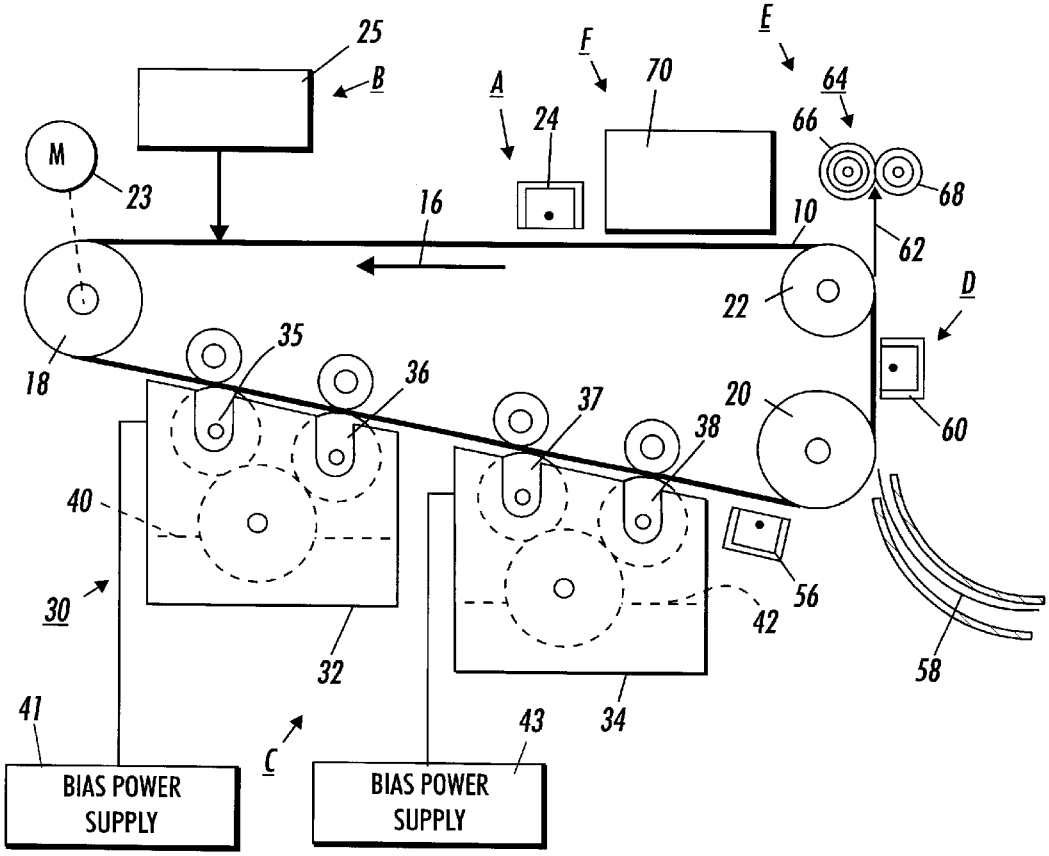
FIG. 3 is a simplified illustration of a printing machine incorporating the present photoreceptor.

A copying or printing machine incorporating the invention may utilize a charge retentive member in the form of a photoconductive drum or belt. In the following there is described a belt machine, as shown in FIG. 3, but those skilled in the art can readilly apply the description to a drum machine. The machine incorporating the invention may utilize a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

Initially successive portions of belt 10 pass through charging station A. At charging station A, a corona discharge device such as a scorotron, corotron, charge roller, brush roller or dicorotron indicated generally by the reference numeral 24, charges the belt 10 to a selectively high uniform positive or negative potential, as required by the photoreceptor. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to exposure device(s) 25 such as a flying spot laser beam output scanning device, LED image bar, or the like well known in the art which causes the charge retentive surface to be discharged in accordance with the output from the scanning device. Preferably the exposure station B can consist of a single wavelength ROS and a conventional light lens exposure device with a selected band of light wavelengths. Alternatively, the scanning device is a two wavelength laser Raster Output Scanner (ROS). The exposure station B may sequentially or simultaneously expose the photoreceptor to the desired light wavelengths.

The photoreceptor, which is initially charged to a higher voltage, undergoes dark decay to a level $V_{high}$. When exposed at the exposure station B it is discharged to $V_{white}$ imagewise in the background (white) image areas by one wavelength or band of wavelengths and to $V_{low}$ which is near zero or ground potential in the highlight (i.e. color other than black) color parts of the image by the second wavelength (or band of wavelengths).

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_{white}$, the direction of offset depending on the polarity of toner in the housing. One housing, e.g., 32 (for the sake of illustration, the first) contains two-component red conductive magnetic brush developer 40 having triboelectric properties such that the red toner is driven to the least highly charged areas at the potential $V_{DAD}$ of the latent image by the electrostatic field (development field) between the photoreceptor and the development rolls 35, 36. These rolls are alternately biased using a chopped DC bias via power supply 41. Conversely, the triboelectric charge on the conductive black magnetic brush developer 42 in the second housing is chosen so that the black toner is urged towards the parts of the latent image at the most highly charged potential $V_{CAD}$ by the electrostatic field (development field) existing between the photoreceptor and the development rolls 37, 38. These rolls are alternately biased using a chopped DC bias via power supply 43.

In tri-level imaging, the CAD and DAD developer housing biases are set at values which are offset from the background voltage by for example approximately 100 volts. During image development the developer bias voltages are continuously applied. Expressed differently, the biases have a duty cycle of 100%. A chopped DC (CDC) bias may be applied to both the CAD and DAD developer housings. By chopped DC is meant that a first bias voltage is applied for a predetermined period of time and a second predetermined higher voltage is applied for a second period of time which differs from the first time period.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner power images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. The magnetic brush cleaner housing 70 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush. Subsequent to cleaning, a discharge lamp (not shown) floods the photoconductive surface with light of both wavelengths to dissipate any residual electrostatic charge remaining prior to the charging thereof for the successive imaging cycle.

Figure 4:
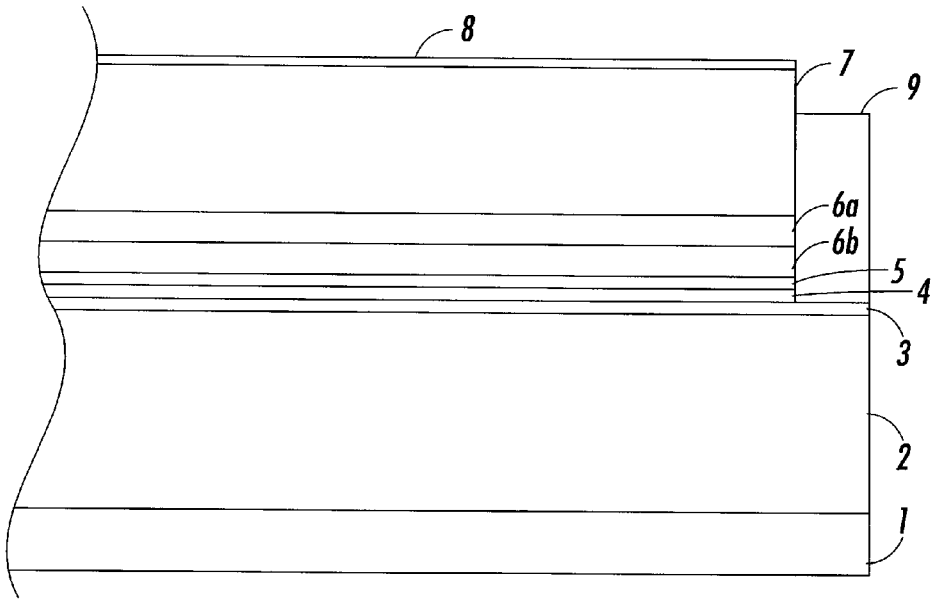
FIG. 4 is a simplified elevational view of a first embodiment of the present photoreceptor.
Figure 5:
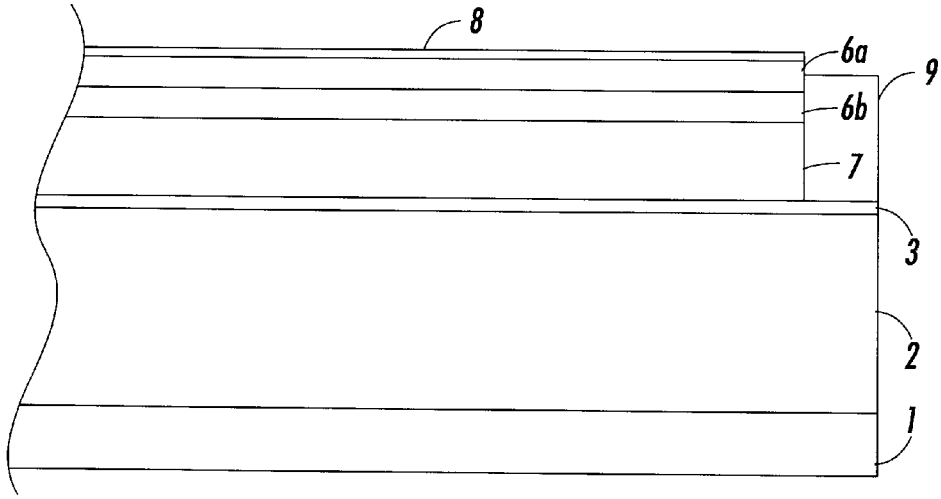
FIG. 5 is a simplified elevational view of a second embodiment of the present photoreceptor.

Representative structures of an inventive electrophotographic imaging member, referred hereafter as photoreceptor, are shown in FIGS. 4–5. The photoreceptors are preferably provided with an electrically conductive supporting substrate 2, a charge blocking layer 4, an optional adhesive layer 5, top charge generating layer 6*a,* bottom charge generating layer 6*b,* a charge transport layer 7, and an optional protective overcoating layer 8.

The transport layer 7 can be positioned anywhere above the substrate such as above or below the multiple charge generating layers. In other embodiments, the charge transport layer can be positioned between the charge generating layers.

The conductive supporting substrate may be provided with an antiplywood surface either directly by roughening the metal surface or an additional electrically ground plane 3 with light scattering functionality to prevent coherent laser light reflected from the substrate and the top surface of the photoreceptor constructively and destructively interfering thus forming a non uniform image commonly referred to as plywood. In the case the photoreceptor is a belt it may be provided with an optional anti-curl layer 1, an electrically conductive ground plane 3 if the supporting substrate is insulating, and a ground strip 9.

Operation of the photoreceptor shown in FIG. 4 is now explained using preferred materials, equipment, and techniques. The bottom generating layer 6*b* is sensitive to, for example long wavelength, red to infra-red light. The photosensitive pigment in such a red sensitive bottom generating layer may be a phthalocyanine, titanyl phthalocyanine ("TiOPc"), hydroxygallium phthalocyanine ("OHGaPc"), chlorogallium phthalocyanine ("ClGaPc") and the like, a squaric acid derivate, or any of the photogenerating pigments well known in the industry. The bottom generating layer 6*b* optionally can be sensitive to visible shorter wavelength light. The top generating layer 6*a* is sensitive to, for example the shorter wavelengths, but is substantially transparent, and hence insensitive, to the longer wavelengths. There is a transition wavelength, which may be a wavelength ranging from about 450 nm to about 700 nm, where wavelengths shorter than this transition wavelength are considered shorter (or short) wavelengths, and wavelengths longer than this transition wavelength are considered longer (or long) wavelengths. The top generating layer 6*a* is a poor transporter of the major charge carrier (typically holes) so that only a fraction of the charge generated in the bottom generating layer reach the charge transport layer 7. The photosensitive pigment in the top generating layer may be any pigment that absorbs in the visible wavelengths such perylenes, azo pigments and the like. The choice of the specific pigment is determined by the cut-off wavelength at which it becomes transparent and transmits the light to the bottom generating layer.

For the photoreceptor of FIG. 4, the surface is charged to a uniform initial voltage. The photoreceptor is exposed to red light (long wavelengths) in a light pattern, corresponding to the image being copied with light lens optics or an image generated digitally. The long wavelength light penetrates to the bottom generating layer 6*b* and a full discharge is obtained to a first residual voltage, $V_{white}$ as in FIG. 1. Because a fraction of the generated holes are trapped in the top generating layer 6*a,* this residual voltage is a high potential. Specifically after a CV (from the capacitance equation) amount of holes, that is an amount equal to the surface charge, are generated the field in the bottom generating layer is reduced to zero and no further discharge occurs even as more light exposure is given. A second pattern on the photoreceptor is exposed to a visible (short wavelength) light, corresponding to another part of the image. The visible light is absorbed in the top generating layer 6*a* also producing a discharge to a second residual voltage, $V_{low}$, which is close to zero volts. The photoreceptor is erased by exposing with broad band light covering both wavelength regions. The residual voltage, $V_{white}$, that the bottom generating layer discharges to, is controlled by the degree of hole trapping and for a given charge generating material by the thickness of the charge generating layer. The electrostatic latent image composed of areas having the initial voltage, the first residual voltage, and the second residual voltage is developed with marking particles of two colors in the manner as discussed previously.

In another embodiment of the present invention, one can use a suitable pigment in the top generating layer that is transparent in the short wavelengths but absorbs and is sensitive in the long wavelength in combination with a bottom generating layer pigment that is sensitive in the short wavelengths, but full exposure in the long wavelength results in the low residual voltage, $V_{low}$, and full exposure in the short wavelength results in the high residual voltage, $V_{white}$.

Operation of the photoreceptor shown in FIG. 5 is now explained using preferred materials, equipment, and techniques. The photoreceptor shown in FIG. 4, where the charge transport layer 7 is on top of the charge generating layers is the preferred structure but in some cases it may be desirable to have the inverted structure with the generating layers on top of the charge transporting layer as shown in FIG. 5. The top generating layer 6*a* is sensitive to, for example, short wavelength light but is substantially transparent, and hence insensitive, to the longer wavelengths. The photosensitive pigment in the top generating layer 6*a* may be any pigment that absorbs in the visible wavelengths such perylenes, azo pigments and the like. The choice of the specific pigment is determined by the cut-off wavelength at which it becomes transparent and transmits the light to the bottom generating layer 6*b*. The photosensitive pigment in such a red sensitive bottom generating layer may be a phthalocyanine such as TiOPc, OHGaPc, ClGaPc and the like, a squaric acid derivate, or any of the photogenerating pigments well known in the industry. The bottom generating layer 6*b* optionally can be sensitive to visible shorter wavelength light. The top generating layer 6*a* is sensitive to, for example the shorter wavelengths. The bottom generating layer 6*b* is a poor transporter of the major charge carrier (typically holes) so that only a fraction of the charge generated in the top generating layer reach the charge transport layer 7.

For the photoreceptor of FIG. 5, the surface is charged to a uniform initial voltage, preferably positive voltage. The photoreceptor is exposed to visible light (short wavelengths) in a light pattern, corresponding to the image being copied with light lens optics (or a CAD image generated digitally). The short wavelength light is absorbed in the top generating layer 6*a* and a full discharge is obtained to a first residual voltage, $V_{white}$ as in FIG. 1. Because a fraction of the generated holes are trapped in the bottom generating layer, this residual voltage is a high potential. Specifically after a CV amount of holes, that is an amount equal to the surface charge, are generated the field in the top generating layer is reduced to zero and no further discharge occurs even as more light exposure is given. A second pattern on the photoreceptor is exposed to a long wavelength light, corresponding to DAD part of the image. The red light penetrates to the bottom generating layer 6*b*, producing a discharge to a second residual voltage, $V_{low}$, which is close to zero volts. The photoreceptor is erased by exposing with broad band light covering both wavelength regions. The residual voltage, $V_{white}$, that the top generating layer discharges to, is controlled by the degree of hole trapping in the bottom generating layer and for a given charge generating material by the thickness of the bottom charge generating layer. The electrostatic latent image composed of areas having the initial voltage, the first residual voltage, and the second residual voltage is developed with marking particles of two colors in the manner as discussed previously.

FIGS. 4–5 illustrate tri-level photoreceptors. Additional voltage levels can be provided by partially discharging, as in Gundlach, U.S. Pat. No. 4,078,929, with the two charge generating layers in FIGS. 4 and 5 or adding more charge generating layers. For example, adding another intermediate charge generating layer to the embodiment of FIG. 4 between top generating layer 6*a* and bottom generating layer 6*b* would result in a quad-level photoreceptor having an electrostatic latent image of five voltage areas, which can be developed with marking particles of four colors. The cut-off wavelengths of the pigments would be chosen such that the top generating layer would be transparent to wavelengths greater than say 500 nm, the intermediate charge generating layer would be transparent to wavelengths greater than say 700 nm.

The first residual voltage may differ from the second residual voltage by a value ranging from about 50 to about 800 volts, preferably from about 200 to about 600 volts, and especially from about 300 to about 500 volts.

The third residual voltage may differ from the first residual voltage and the second residual voltage by a value ranging from about 50 to about 800 volts, preferably from about 200 to about 600 volts, and especially from about 300 to about 500 volts.

The Anti-Curl Layer

For some applications, an optional anti-curl layer 1 can be provided, which comprises film-forming organic or inorganic polymers that are electrically insulating or slightly semi-conductive. The anti-curl layer provides flatness and/or abrasion resistance.

Anti-curl layer 1 can be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate, mixtures thereof and the like.

Additives may be present in the anti-curl layer in the range of about 0.5 to about 40 weight percent of the anti-curl layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers and, preferably, about 14 micrometers. However, thicknesses outside these ranges can be used.

The anti-curl coating can be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer can be accomplished simultaneously by web coating onto a mulilayer photoreceptor comprising a charge transport layer, charge generation layer, adhesive layer, blocking layer, ground plane and substrate. The wet film coating is then dried to produce the anti-curl layer 1.

The Supporting Substrate

As indicated above, the photoreceptors are prepared by first providing a substrate 2, i.e., a support. The substrate can be opaque or substantially transparent and can comprise any of numerous suitable materials having given required mechanical properties.

The substrate can comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate can be flexible or rigid and can have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins can be used as electrically non-conducting materials, including, but not limited to, polyesters, polycarbonates, polyamides, polyurethanes, and the like. Such a substrate preferably comprises a commercially available biaxially oriented polyester known as MYLAR™, available from E. I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E. I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor can also be coated on an insulating plastic drum, provided a conducting ground plane has previously been coated on its surface, as described above. Such substrates can either be seamed or seamless.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum can be used, as well as the preferred conducting metal drum made from a material such as aluminum.

The preferred thickness of the substrate depends on numerous factors, including the required mechanical performance and economic considerations. The thickness of the substrate is typically within a range of from about 65 micrometers to about 150 micrometers, and preferably is from about 75 micrometers to about 125 micrometers for optimum flexibility and minimum induced surface bending stress when cycled around small diameter rollers, e.g., 19 mm diameter rollers. The substrate for a flexible belt can be of substantial thickness, for example, over 200 micrometers, or of minimum thickness, for example, less than 50 micrometers, provided there are no adverse effects on the final photoconductive device. Where the preferred aluminum drum is used, the thickness should be sufficient to provide the necessary rigidity. This is usually about 1–6 mm.

The surface of the substrate to which a layer is to be applied is preferably cleaned to promote greater adhesion of such a layer. Cleaning can be effected, for example, by exposing the surface of the substrate layer to plasma discharge, ion bombardment, and the like. Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

If a diffuse reflective surface is required the surface of the substrate may be roughened by any known technique suitable to the particular material. Thus, for example, in the case of a rigid metal tube, typically of aluminum, the surface may be roughened by honing or sand blasting, i.e., bombarding with fine particles, or special lathing, chemical etching, anodizing and the like. If the substrate is prepared by electroforming, the roughness may be produced by proper electrochemical process conditions. If the substrate is a flexible polymeric film the roughness can be produced by incorporating fillers that produce the desired roughness.

Alternatively, the anti-plywood diffuse light reflection function may be produced by a separate layer loaded with light scattering particles. This layer may be incorporated between the electrically conducting ground plane and the charge blocking layer.

The Electrically Conductive Ground Plane

As stated above, photoreceptors prepared in accordance with the present invention comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate can act as the conductive layer, although a conductive ground plane may also be provided.

If an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium are preferred.

The ground plane can be applied by known coating techniques, such as solution coating, vapor deposition, and sputtering. A preferred method of applying an electrically conductive ground plane is by vacuum deposition. Other suitable methods can also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 angstroms and about 750 angstroms; more preferably, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, an optional charge blocking layer 4 can be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

If a blocking layer is employed, it is preferably positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer 4 can include polymers, such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033, and 4,291,110.

A preferred hole blocking layer comprises a reaction product of a hydrolyzed silane or a mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes can then be used as is well known in the art. For example, see U.S. Pat. No. 5,091,278 to Teuscher et al.

The blocking layer 4 should be continuous and can have a thickness of up to 2 micrometers depending on the type of material used.

However, the blocking layer preferably has a thickness of less than about 0.5 micrometer because greater thicknesses may lead to undesirably high residual voltage. A blocking layer between about 0.005 micrometer and about 0.3 micrometer is satisfactory for most applications because charge neutralization after the exposure step is facilitated and good electrical performance is achieved. A thickness between about 0.03 micrometer and about 0.06 micrometer is preferred for blocking layers for optimum electrical behavior.

The blocking layer 4 can be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.5:100 to about 5.0:100 is satisfactory for spray coating.

The Adhesive Layer

An optional intermediate layer 5 between the blocking layer and the charge generating layer may, if desired, be provided to promote adhesion. However, in the present invention, a dip coated aluminum drum may be utilized without an adhesive layer.

Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers preferably have thicknesses of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E. I. duPont de Nemours & Co.), Vitel PE-100 (available from Goodyear Tire and Rubber Co.), polyvinyl butyral, polyvinyl pyrrolidone, polyurethane, polymethyl methacrylate, and the like.

The Imaging Layer(s)

In fabricating a photosensitive imaging member, a charge generating material (CGM) or pigment, herein the terms "pigment" and "charge generating material" are used interchangebly, and a charge transport material (CTM) may be deposited onto the substrate surface either in a laminate type configuration where the CGM and CTM are in different layers or in a single layer configuration where the CGM and CTM are in the same layer along with a binder resin. The photoreceptors embodying the present invention can be prepared by applying over the electrically conductive layer the charge generation layers and a charge transport layer. In embodiments, the charge generating layers (6*a,* 6*b*) and the charge transport layer 7 may be applied in any order.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene bisimide pigments; indigo pigments such as indigo, thioindigo, and the like; bisbenzoimidazole pigments such as Indofast Orange toner, and the like; phthalocyanine pigments such as titanyl phthalocyanine, aluminochlorophthalocyanine, hydroxygalliumphthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

The pigment or generating material for the two charge generating layers are selected so that the pigment in the first layer in the path of the exposure light is substantially transparent to wavelengths that are absorbed and generate charge in the second layer and the pigment in the second layer is sensitive and photogenerates charge for some wavelengths that are passed through the first layer. The terms "first" and "second layer," as used herein refers to relative placement of the layers relative to the direction of the exposure light, so that if the light is coming from the top, the preferable design, the first layer is on top, and if the light is coming from the bottom, i.e., through the substrate, then the first layer is below the second layer. Thus, for example, the pigment in the first layer is sensitive hence absorbs short, i.e., blue-green, wavelengths and is transparent to long, i.e., red, wavelengths, while the pigment in the second layer is sensitive to red wavelengths. Alternatively, the pigment in the first layer may be transparent to the short wavelengths and absorb and be sensitive to the long wavelengths, while the pigment in the second layer is sensitive to the transmitted short wavelengths. Preferably, the first layer must be transparent to the wavelengths that must reach and generate charge in the second layer. In the case of three charge generating layers, the first two must be transparent to the wavelengths that must reach and generate charge in the third layer, and similarly for four layers.

Illustrative examples of pigments that absorb and are sensitive to short wavelengths but are transparent to long wavelengths are typically yellow, orange or red colored pigments, while those that absorb and are sensitive to long wavelegths are typically dark magenta, purple or blue in color. Examples of short wavelength sensitive pigments are perylene bisimides such as phenylbisimide, alkyl bisimides such as methylbisimide, butylbisimide and the like, bisazo pigments and the like, polycyclics such as polyacenes, dibromo-anthanthrone and the like. Examples of long wavelength sensitive pigments are all the various phthalocyanines, squaraine derivatives and certain red, near-infrared sensitive azos. Illustrative example of pigments for a three generation layer photoreceptor would be an alkyl bisimide such as n-propyl bisimide perylene with sensitivity to about 620 nm and transparent beyond 650 nm, a benzimidazole bisimide perylene (benzimidazole perylene-3,4,9,10-tetracarboxylic acid diimide) with sensitivity to 760 nm and transparent beyond 800 nm and titanyl phthalocyanine with sensitivity to 830 nm.

Any suitable resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, polyvinylbutyrals and the like.

It is preferred that the charge generating layer adjacent to the charge transporting layer be partially trapping to charge generated in the other charge generating layer(s) which are passing through this layer to the charge transporting layer. Normally, the above photoexcited charges are holes so the generation layer adjacent to the transport layer must be partially trapping to holes transiting through it, but if the transport layer transports electrons it would be electron trapping. This functionality can be in the pigment itself, that is, the pigment may be a good electron transporter but a poor hole transporter. Such pigments are sometimes referred to as extrinsic pigments because they require the presence of hole transport, i.e., electron donor, molecules. Examples of extrinsic electron transporting pigments are perylene and azo pigments and their derivatives. The degree of hole trapping can be controlled by introducing hole transport molecules either directly or by diffusion from the charge transport layer. Examples of charge transport materials are listed below. Alternatively or in combination, additives can be used to increase the charge trapping. Thus in case of ambipolar, also referred to as intrinsic, pigments such as phthalocyanines, trapping additives in combination with charge transport molecules can be added. Suitable additives are other charge transport materials whose energy levels are 0.2 eV different from the primary charge transport molecule.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone, biphenylquinone derivatives and phenylquinone derivatives.

Any suitable inactive resin binder with the desired mechanical properties may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layers. Typical application techniques include spraying, dip coating, roll coating, wire wound rod coating, vacuum coating, and the like. Drying of the deposited coating may be effected by any suitable conventional technique such as oven drying, infra-red radiation drying, air drying and the like. Generally, the thickness of each charge generating layer ranges from about 0.1 micrometer to about 3 micrometers and the thickness of the transport layer is between about 5 micrometers to about 100 micrometers, but thicknesses outside these ranges can also be used. The thickness of the charge generating layer adjacent to the charge transport layer is selected so that the required fraction of the charge is trapped resulting in the desired voltage. The desired thickness is then governed by the fraction of charge transiting the charge generating layer adjacent to the charge transport layer. In general, the ratio of the thickness of the charge transport layer to the charge generating layer is preferably maintained from about 2:1 to 200:1 and in some instances as great as 400:1.

The Overcoating Layer

Embodiments in accordance with the present invention can, optionally, further include an overcoating layer or layers 8, which, if employed, are positioned over the charge generation layer or over the charge transport layer and provide mechanical or environmental protection to the electronically active layers. This layer comprises organic polymers or inorganic polymers that are electrically insulating or charge transporting.

Such a protective overcoating layer includes a film forming resin binder optionally doped with a charge transport material.

Any suitable film-forming inactive resin binder can be employed in the overcoating layer of the present invention. For example, the film forming binder can be any of a number of resins, such as polycarbonates, polyarylates, polyesters, polyimides, polysiloxanes, polystyrene, polysulfone, polyphenylene sulfide, polyetherimide, polyphenylene vinylene, and polyacrylate. It may be preferable that the overcoating be a crosslinkable polymer for toughness. The resin binder used in the overcoating layer can be the same or different from the resin binder used in the anti-curl layer or in any charge transport layer that may be present. The binder resin should preferably have a Young's modulus greater than about $2\times10^5$ psi and a break elongation no less than 10%. The binder may further be a blend of binders. The preferred polymeric film forming binders include MAKROLON™, a polycarbonate resin having a weight average molecular weight of about 50,000 to about 100,000 available from Farbenfabriken Bayer A. G., 4,4'cyclohexylidene diphenyl polycarbonate, available from Mitsubishi Chemicals, high molecular weight LEXAN™ 135, available from the General Electric Company, ARDEL™ polyarylate D-100, available from Union Carbide, and polymer blends of MAKROLON™ and the copolyester VITEL™ PE-100 or VITEL™ PE-200, available from Goodyear Tire and Rubber Co.

In embodiments, a range of about 1% by weight to about 10% by weight of the overcoating layer of VITEL™ copolymer is preferred in blending compositions, and, more preferably, about 3% by weight to about 7% by weight. Other polymers that can be used as resins in the overcoat layer include DUREL™ polyarylate from Celanese, polycarbonate copolymers LEXAN™ 3250, LEXAN™ PPC 4501, and LEXAN™ PPC 4701 from the General Electric Company, and CALIBRE™ from Dow.

Additives may be present in the overcoating layer in the range of about 0.5 to about 40 weight percent of the overcoating layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Charge transporting additives such as electron donor molecules may be present in the overcoating layer. They may be the same or different than those in the charge transport layer. Preferrably their concentration is less than that in the charge transport layer. Alternatively, the charge transporting additives may be incoporated into the overcoating polymer. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

Charge transporting additives such as electron donor molecules may be present in the overcoating layer. They may be the same or different than those in the charge trasport layer. Preferrably their consentration is less than that in the charge transport layer. Alternatively, the charge transporting additives may be incoporated into the overcoating polymer.

The overcoating layer can be prepared by any suitable conventional technique and applied by any of a number of application methods. Typical application methods include, for example, hand coating, spray coating, web coating, dip coating, chemical vapor deposition, and the like. Drying of the deposited coating can be effected by any suitable conventional techniques, such as oven drying, infrared radiation drying, air drying, and the like.

Overcoatings of from about 0.1 micrometer to about 7 micrometers are effective in preventing charge transport molecule leaching, crystallization, and charge transport layer cracking. Preferably, a layer having a thickness of from about 3 micrometers to about 5 micrometers is employed.

The Ground Strip

In the case of photoreceptors with an insulating substrate, a ground strip is required to make electrical contact with the ground plane. Ground strip 9 can comprise a film-forming binder and electrically conductive particles. Cellulose may be used to disperse the conductive particles. Any suitable electrically conductive particles can be used in the electrically conductive ground strip layer 9. The ground strip 9 can, for example, comprise materials that include those enumerated in U.S. Pat. No. 4,664,995. Typical electrically conductive particles include, but are not limited to, carbon black, graphite, copper, silver, gold, nickel, tantalum, chromium, zirconium, vanadium, niobium, indium tin oxide, and the like.

The electrically conductive particles can have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers and, preferably, from about 14 micrometers to about 27 micrometers.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

A photoconductive imaging member was prepared by providing a web of titanium coated polyester (Melinex, available from ICI Americas Inc.) substrate having a thickness of 3 mils, and applying thereto, with a gravure applicator, a solution containing 50 grams 3-aminopropyltriethoxysilane, 41.2 grams water, 15 grams acetic acid, 684.8 grams of 200 proof denatured alcohol and 200 grams heptane. This layer was then dried for about 5 minutes at 135° C. in the forced air drier of the coater. The resulting charge blocking layer had a dry thickness of 50 nanometers.

An adhesive interface layer was then prepared by applying a wet coating over the blocking layer, using a gravure applicator, containing 3.5 percent by weight based on the total weight of the solution of copolyester adhesive (49,000, available from Morton International, Specialty Chemicals Group) in a 70:30 volume ratio mixture of tetrahydrofuran and cyclohexanone. The adhesive interface layer was then dried for about 5 minutes at 135° C. in the forced air dryer of the coater. The resulting adhesive interface layer had a dry thickness of 62 nanometers.

The first photogenerator layer (i.e., the bottom generating layer) was prepared from a pigment dispersion containing 40 percent by volume of hydroxygallium phthalocyanine Type V, and 60 percent by volume of copolymer polystyrene (90 percent)/poly-4-vinyl pyridine (10 percent) with Mw of 15,000, as follows: 1.5 gram of polystyrene/poly-4-vinyl pyridine was dissolved in 50 milliliters of toluene in a 4 ounce amber bottle. To this solution was added 1.33 gram of Type V hydroxygallium phthalocyanine and 300 grams of ⅛ inch diameter stainless steel shot. This mixture was then placed on a roll mill for 24 hours. The resulting slurry was, thereafter, applied to the adhesive interface with a Bird applicator to form a layer having a wet thickness of 0.25 mil. The layer was dried at 135° C. for 5 minutes in a forced air oven to form a dry thickness photogenerating layer having a thickness of 0.4 micrometer.

The second photogenerator layer (i.e., the top generating layer) was prepared from a pigment dispersion of 80% 5-3-5 imido perylene dimer in 20% polyvinylbutyl polymer as follows: 0.2 g of the perylene dimer pigment was mixed with 0.05 gram of polyvinylbutyral (PVB) polymer, 3.5 g tetrahydrofuran (THF), 3.5 g toluene in a 30 milliliter glass bottle containing 70 g of ⅛-inch stainless steel balls. The bottle was placed on a roller mill, and the dispersion was milled for 4 days. Using a Bird applicator, the pigment dispersion was coated to form a second photogenerator layer over the above first photogenerator layer having a wet thickness of 0.25 mil. The layer was dried at 135° C. for 5 minutes in a forced air oven to form a dry thickness photogenerating layer having a thickness of 0.4 micrometer. The photogenerator layer was overcoated with a charge transport layer prepared as follows. A transport layer solution was prepared by mixing 6.3 g of MAKROLON® (a polycarbonate resin), 6.3 g of N,N'-diphenyl-N,N'-bis(3-methylphenyl)-(1,1'-biphenyl)-4,4'-diamine and 72 g of methylene chloride. The solution was coated onto the above second photogenerating layer using a Bird applicator of 10 mil gap. The resulting member was dried at 135° C. in a forced air oven for 60 minutes and the final dried thickness of transport layer was about 25 microns.

The photoreceptor was evaluated to determine its photodischarge curves in response to monochromatic light from wavelengths of 410 nm light in the blue to 900 nm light in the near infra-red. The photoreceptor was tested in a standard xerographic scanner. It was charged with a corona discharging device to an initial voltage of about a 1000 volts, corresponding to an electric field of 40 volts/micrometer, and erased with a broadband (xenon) erase light of high intensity. The sample was thus cycled at a repetition rate of 20 rpm, by charging and erasing for several thousand cycles. During the cycling the samples were exposed to monochromatic light after charging and the corresponding surface potential after exposure was measured for 32 different intensities of light. Photodischarge curves were taken with filtered monochromatic light in 10 nm steps from 410 nm to 900 nm. The results at two wavelengths, 600 nm and 780 nm, are depicted in FIG. 1.

EXAMPLE 2

Photoreceptor devices were prepared as in Example 1 except the thickness of the second photogenerator layer (i.e., top generating layer adjacent to the charge transport layer) containing the perylene dimer pigment was varied by using a Bird applicator with different mil gaps to produce dried film thicknesses of about 0.2, about 0.4 and about 0.8 micrometer.

Figure 6:
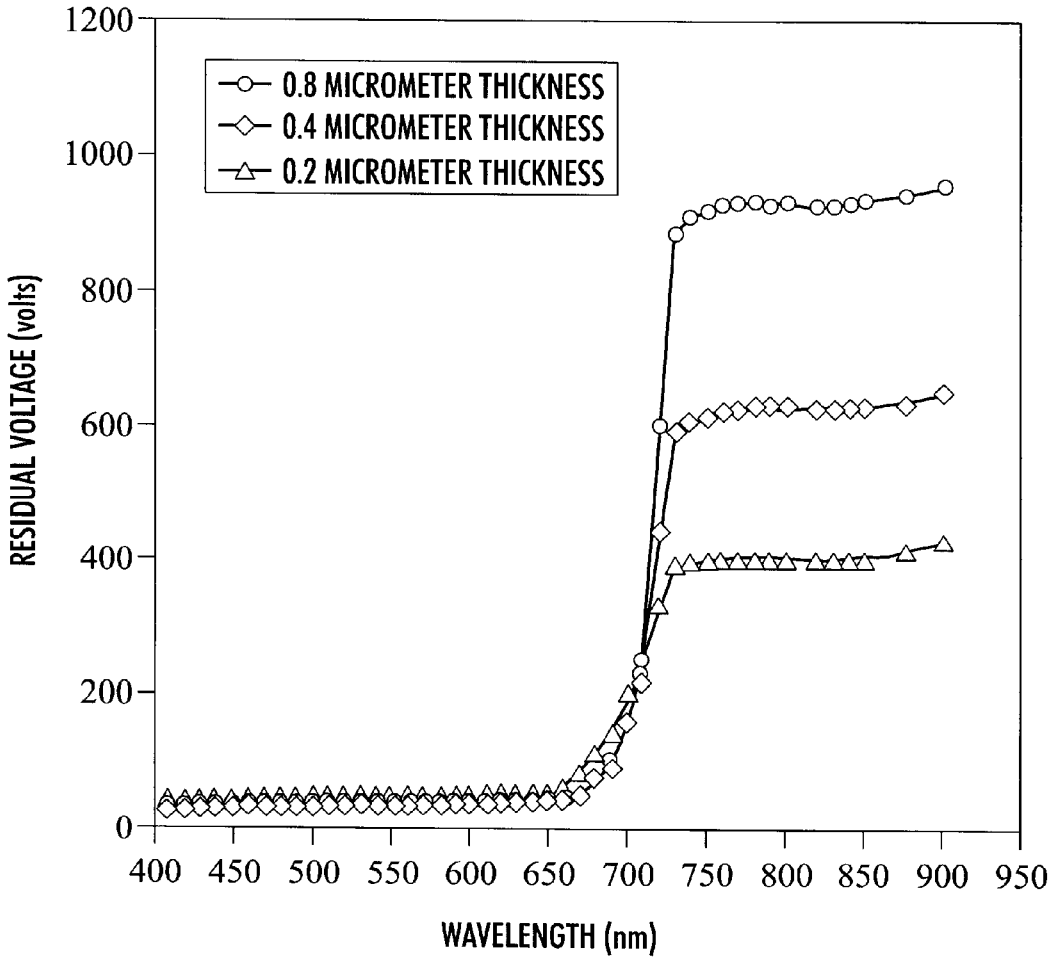
FIG. 6 is a plot of the residual voltage for the present photoreceptor in response to light wavelengths.

The photoreceptors were evaluated to determine their photodischarge curves in response to monochromatic light from wavelengths of 410 nm light in the blue to 900 nm light in the near infra-red. Each photoreceptor was tested in a standard xerographic scanner. It was charged with a corona discharging device to an initial voltage of about 1000 volts, corresponding to an electric field of 40 volts/micrometer, and erased with a broadband (xenon) erase light of high intensity. The samples were thus cycled at a repetition rate of 20 rpm, by charging and erasing for several thousand cycles. During the cycling the samples were exposed to monochromatic light after charging and the corresponding suface potential after exposure was measured for 32 different intensities of light. Photodischarge curves were taken with filtered monochromatic light in 10 nm steps from 410 nm to 900 nm. The resulting residual voltage is shown in FIG. 6.

It was thus discovered that the top generating layer thickness (containing perylene pigment) affected the residual voltage level of the long wavelength discharge, but not the visible discharge.

Other modifications of the present invention may occur to those skilled in the art based upon a reading of the present disclosure and these modifications are intended to be included within the scope of the present invention.

We claim:

1. An imaging method comprising:

(a) providing a photoreceptor including a first charge generating layer contacting a second charge generating layer, wherein the first charge generating layer exhibits a first residual voltage with exposure to a first light band, and the second charge generating layer exhibits a different second residual voltage with exposure to a different second light band, and charging the photoreceptor to an initial voltage;

(b) exposing a portion of the first charge generating layer to the first light band to discharge the first charge generating layer portion to the first residual voltage and exposing a portion of the second charge generating layer to the different second light band to discharge the second charge generating layer portion to the different second residual voltage, thereby creating an electrostatic latent image; and (c) developing the electrostatic latent image with marking particles of at least two colors.

2. The method of claim 1, wherein the first residual voltage differs from the second residual voltage by a value ranging from about 50 to about 800 volts.

3. The method of claim 1, wherein the first residual voltage differs from the second residual voltage by a value ranging from about 200 to about 600 volts.

4. The method of claim 1, wherein the photoreceptor further includes a third charge generating layer that exhibits a third residual voltage different from the first residual voltage and the second residual voltage with exposure to a third light band different from the first light band and the second light band, wherein the third charge generating layer contacts either the first charge generating layer or the second charge generating layer, the method further comprising: exposing a portion of the third charge generating layer to discharge the third charge generating layer portion to the third residual voltage, and wherein the electrostatic latent image is developed with marking particles of at least three colors.

* * * * *